United States Patent [19]

Masclet

[11] 4,025,238

[45] May 24, 1977

[54] APPARATUS FOR ELIMINATING THE EFFECTS OF CAVITATION IN A MAIN PUMP

[75] Inventor: Jean Masclet, Paris, France

[73] Assignee: Messier Hispano, Montrough, France

[22] Filed: Apr. 17, 1975

[21] Appl. No.: 569,087

[30] Foreign Application Priority Data

Apr. 24, 1974 France ..... 74.14208

[52] U.S. Cl. ..... 417/203; 417/206; 417/251; 417/252; 222/146 H

[51] Int. Cl.[2] ..... F04B 23/04; B67D 5/62

[58] Field of Search ..... 417/203, 206, 251, 252; 222/146 H

[56] References Cited

UNITED STATES PATENTS

| | | | |
|---|---|---|---|
| 2,365,309 | 12/1944 | Talbot | 417/203 |
| 2,604,047 | 7/1952 | Beaman et al. | 417/252 |
| 2,743,674 | 5/1956 | Shaw | 417/252 |
| 2,999,463 | 9/1961 | Johnson | 417/203 |
| 3,053,186 | 9/1962 | Gondek | 417/206 |
| 3,066,609 | 12/1962 | Hann | 417/206 |
| 3,202,101 | 8/1965 | Tinker et al. | 417/203 |
| 3,380,392 | 4/1968 | Boers | 417/206 |
| 3,672,793 | 6/1972 | Yowell | 417/203 |

FOREIGN PATENTS OR APPLICATIONS

| | | | |
|---|---|---|---|
| 600,478 | 2/1926 | France | 222/146 |

*Primary Examiner*—John J. Vrablik
*Assistant Examiner*—Gregory Paul LaPointe

[57] ABSTRACT

Apparatus for eliminating cavitation in a main pump in which the rotor of a supercharging pump is connected to the rotor of the main pump such that the latter rotor drives the rotor of the supercharging pump. Permanent communication is established between the delivery side of the supercharging pump and the induction inlet of the main pump. A hydraulic fluid reservoir is connected to the inlet of the supercharging pump and it is also connected to the delivery side of the supercharging pump through the intermediary of a valve which controls the flow of hydraulic fluid to the reservoir from the delivery side of the supercharging such that when the pressure at the induction inlet of the main pump exceeds a predetermined value flow is established to the reservoir in order to avoid the appearance of cavitation in the main pump. Leakage flow within the main pump is also recycled to the reservoir continuously through the valve.

4 Claims, 1 Drawing Figure

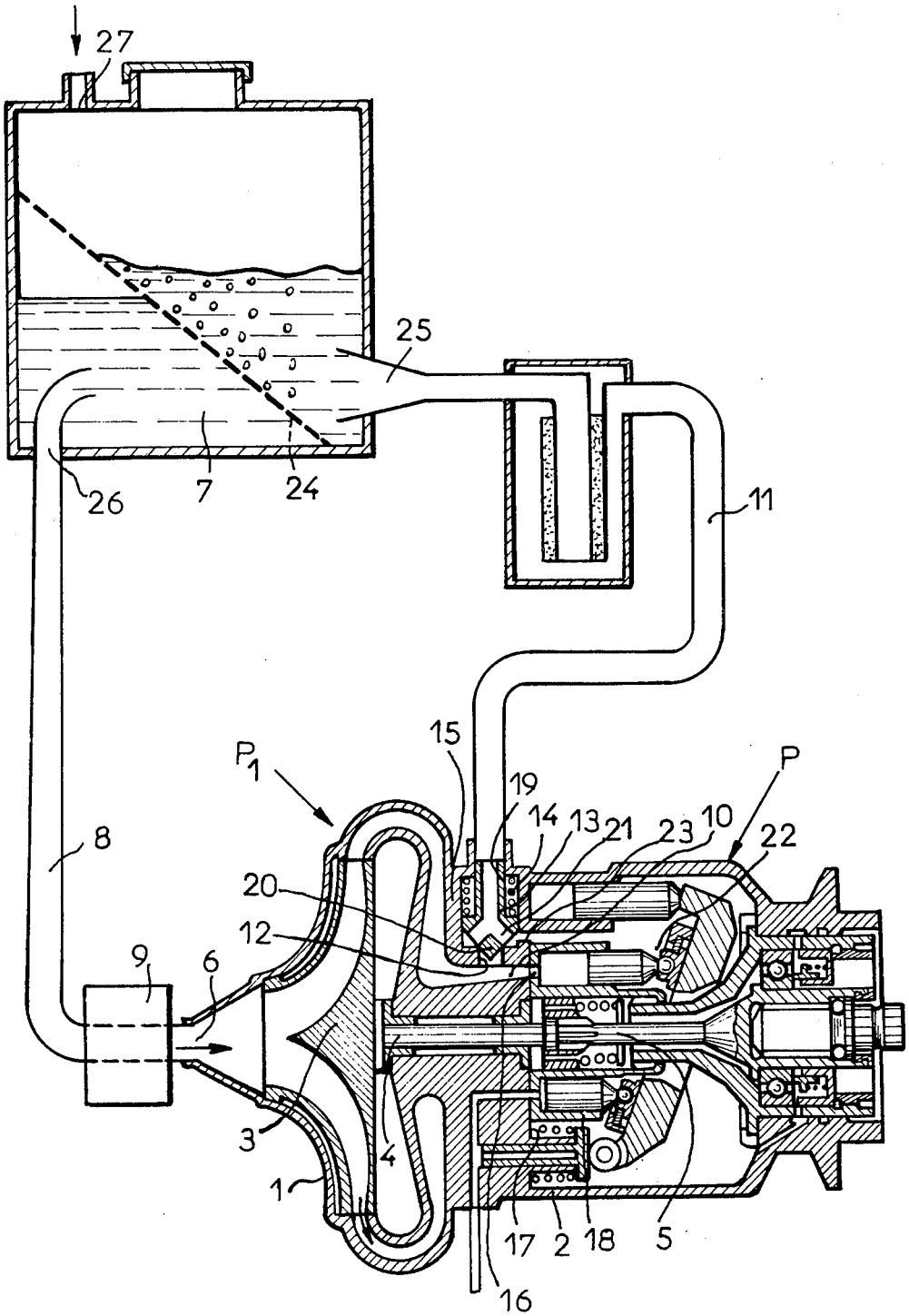
27
25
26
7
24
11
15
P1
19
14
13
21
23
10
P
22
8
20
12
9
6
3
4
1
17
2
18
5
16

APPARATUS FOR ELIMINATING THE EFFECTS OF CAVITATION IN A MAIN PUMP

The present invention relates to a system which makes it possible to eliminate the effects of cavitation which may occur in a pump, for example in an axial-piston self-regulating pump.

The self-regulating pumps which are generally used on aircraft have rates of delivery which may vary within wide proportions (from a few percent to 100 percent) and they may do so within very short periods of time which may be of the order of one-hundredth of a second. The velocity of the medium in the inlet ducting, which may be of considerable length, must be capable of varying very rapidly from a speed of virtually zero to the maximum speed and vice versa, which may transiently create cavitation phenomena which are likely to disturb the functioning and shorten the life of the pumps.

In order to remedy such disadvantages, the practice has more often than not been to pressurize the hydraulic fluid supply reservoir by drawing off the air under pressure, either from the pressurized cabin or from the compressor driven by the motor which likewise drives the pump.

It is also possible to eliminate cavitation phenomena by creating a pressure at the inlet to the pump, doing so by using a reservoir having a stepped piston, the small section of which receives the pressure of delivery. This solution is only satisfactory if the inlet pressure is judiciously chosen, and moreover it may result in a poor efficiency of the circuit when it is required to obtain the full rate of flow while the delivery pressure of a pump is fairly low.

Under all these conditions, it will be necessary to have available adequate pressure to overcome the loss of head between the reservoir and the self-regulating pump and to be able to adequately accelerate the rate of induction in order to temporarily avoid cavitation. These problems arise even more acutely in the event of a failure in the pressurization of systems utilizing auxiliary gas sources, that is to say the first two systems indicated.

Another known solution to the elimination of cavitation due to sudden demands for flow comprises placing in the delivery circuit of the self-regulating pump an accumulator which provides a fraction of the flow required and therefore also reduces the rate of flow which the pump has to provide, and the necessary acceleration in order to increase the velocity of the column of hydraulic fluid inducted into the pump.

However, the use of an accumulator is not very desirable by reason of its bulk and its vulnerability, as well as by reason of its lack of flexibility in operation.

The present invention proposes a system for eliminating cavitation in a pump, for example a main axial-piston self-regulating pump, which is free from all the previously indicated disadvantages and which does not require the use of an accumulator.

The system according to the invention is characterized in that it comprises using a supercharging pump, the rotor of which is driven by the rotor of the main pump, and establishing, on the one hand, a permanent main communication between the induction orifice of the said main pump and the delivery from the supercharging pump, and on the other hand, a branched communication between the said delivery and the hydraulic fluid supply reservoir, which opens when the pressure in the said induction orifice exceeds a predetermined value.

More specifically the apparatus, the rotor comprises a main pump, a supercharging pump, the rotor of which is driven by that of the main pump, a hydraulic fluid reservoir communicating with the intake of the supercharging pump, the delivery side of the latter communicating, on the one hand, with the reservoir via an orifice of the supercharging pump, operated by a valve maintained normally closed by resilient means exerting a predetermined force, and on the other hand, communicating permanently with the induction aperture of the main pump.

Thus, whatever the speed of rotation of the rotors of the main pump and of the supercharging pump, if the high pressure circuit requires maximum delivery to the main pump, the majority of the flow from the supercharging pump will flow into the main pump, and thus cavitation is avoided. A fraction of the excess flow from the supercharging pump flows to the reservoir via the secondary ducting after having lifted a pressure limiting valve located in series between this pump and the reservoir.

When the high pressure circuit requires a fraction of the maximum flow from the main pump, the flow in the secondary ducting, between the supercharging pump and the reservoir, is increased.

One embodiment of the invention will now be described by way of non-limitative example, with reference to the single FIGURE of the attached drawing which shows in cross-section a device for supercharging a self-regulating pump.

The supercharging device according to the invention may be combined with the majority of the known types of pump. In the example illustrated, the main pump chosen is a self-regulating pump having axial pistons.

The device according to the invention comprises a supercharging pump $P_1$ consisting of a housing 1 which is rigid with the housing 2 of the self regulating pump P. The rotor of the supercharging pump $P_1$ is driven through an intermediate shaft 4 by the shaft 5 of the self-regulating pump P. The pump $P_1$ may be of the centrifugal, helical-centrifugal or axial type.

The supercharging pump $P_1$ comprises an inlet aperture 6 connected to a reservoir 7 containing hydraulic fluid, through a duct 8. A radiator 9 may be provided to heat the hydraulic fluid before its induction into the pump $P_1$ in order to allow for any possible fluctuations in ambient temperature. After having passed through the delivery duct 10 from the pump $P_1$, the fluid is delivered to a duct 11 which returns it to the reservoir, through an aperture 12 maintained normally closed by a valve 13 biased by a calibrated spring 14. Calibration of the spring 14 is such that, over the entire range of operation of the main pump and of the supercharging pump, and more particularly at altitude, the pressure prevailing the intake of the main pump is adequate to avoid the appearance of cavitation.

The valve 13 and the spring 14 are mounted inside a housing 15 which is rigid with the pump $P_1$. The delivery duct 10 of the pump $P_1$ is connected to the orifice 16 every time this latter assumes a position in front of the duct 10. In the case illustrated, the interface 17 of the supercharging pump $P_1$ constitutes the "face" on which the piston-barrel chamber 18 of the self-regulating pump is applied.

The valve 13 comprises a tubular body 19 and a flared head 20 provided with transverse holes 21 which establish communication between the internal volume 22 of the main pump P and the inner bore of the valve 13, through a passage 23 provided in the "face" 17. The bore in the valve 13 itself communicates with the return duct 11.

When the speed of rotation of the main pump P is low, the delivery from the supercharging pump $P_1$ is completely drawn in by the pump P. If the speed of rotation increases, a time comes when the pressure created in the delivery duct 10 becomes sufficient to open the valve 13. The fraction of delivery in excess of that which is inducted by the pump P returns to the reservoir 7 through the passage 12 and the duct 11 and continues to flow in a cloud loop back to inlet 6 via duct 8, while at the same time the leakage flow passages from the main pump P to the reservoir. This latter flow which escapes between the piston barrel chamber 18 and the "face" 17 travels to the duct 11 through the passage 23 and the holes 21 in the valve 13. The remaining fraction of the delivery flows into the main pump P.

In a manner known per se, the reservoir 7 comprises a grille 24 separating the return orifice 25 and the outlet orifice 26 for fluid, in order to prevent the passage of emulsified fluid to the supercharged pump $P_1$.

Furthermore, it is advantageous to create a "cramming" effect, that is to say a variable overpressure of supply, the effect of which will be to compensate for differences in pressure due to changes in altitude which an aircraft may make between the ground and its maximum altitude of flight. For this, it is possible to pressurize the reservoir 7 through the orifice 27 in order to increase the pressure at which the hydraulic fluid feeds the supercharging pump $P_1$.

I claim:

1. Pumping apparatus comprising a main pump having a rotor, a supercharging pump having a rotor, the rotors of the main pump and supercharging pump being coupled in driving relation such that the rotor of the main pump drives the rotor of the supercharging pump, a reservoir for hydraulic fluid external of said main and supercharging pump, said supercharging pump having an inlet connected to said reservoir for receivng hydraulic fluid therefrom and a delivery outlet connected to the inlet of the main pump, said supercharging pump having a further outlet, a duct connecting said further outlet to said reservoir thereby establishing a closed loop for circulation of fluid between the outlet and the inlet of the supercharging pump, a valve means controlling communication between said duct and said further outlet, resilient means acting on said valve means to close the communication between said further outlet and said duct, said resilient means acting on said valve means with a predetermined force which is overcome when the pressure at the inlet of the main pump reaches a predetermined level whereby to avoid the appearance of cavitation in said main pump, a housing rigid with said supercharging pump, said valve means comprising a valve slidably mounted in said housing, said valve comprising a tubular body connected to said duct and a flared-out head on said tubular body normally applied by the said resilient means against a first aperture in the housing constituting the further outlet from said supercharging pump thereby closing said outlet, said aperture connecting the delivery outlet of the supercharging pump with the interior of the housing, said head of the valve having transverse holes located downstream of said first aperture, said housing having a first orifice for the uninterrupted flow of leakage fluid from the main pump to the housing and thence through the transverse holes in said head of the valve, and a second orifice receiving said duct and through which the flow of leakage flow and the fraction of flow delivered by the supercharging pump via said further outlet when the valve is opened are recycled towards the reservoir via the transverse holes and the tubular body of the valve.

2. An apparatus as claimed in claim 1 comprising a radiator mounted between said reservoir and the inlet of the supercharging pump.

3. An apparatus as claimed in claim 2 in which said reservoir comprises means for pressurizing the hydraulic fluid therein.

4. An apparatus as claimed in claim 1 wherein said main pump has an inner volume which permanently communicates with said first orifice on said housing via an aperture provided in said main pump.

* * * * *